United States Patent [19]

Soeda et al.

[11] 4,251,796

[45] Feb. 17, 1981

[54] SLIDE-TYPE POTENTIOMETER

[75] Inventors: Katsuji Soeda; Mitsuhiro Oyama; Fumio Sakuma, all of Sukagawa, Japan

[73] Assignee: Yamamoto Electric Industrial Co., Ltd., Fukushima, Japan

[21] Appl. No.: 20,840

[22] Filed: Mar. 15, 1979

[30] Foreign Application Priority Data

Apr. 18, 1978 [JP] Japan ..... 53-51172[U]

[51] Int. Cl.[3] ..... H01C 10/38

[52] U.S. Cl. ..... 338/176; 338/160

[58] Field of Search ..... 338/176, 153, 158, 160, 338/161, 165, 180–182, 188, 194, 118

[56] References Cited

U.S. PATENT DOCUMENTS

| | | | |
|---|---|---|---|
| 1,559,427 | 10/1925 | Hemphill | 338/153 X |
| 2,192,714 | 3/1940 | Norman et al. | 338/153 X |
| 2,900,615 | 8/1959 | Gottschall et al. | 338/176 |
| 2,904,766 | 9/1959 | McMillan | 338/176 |
| 2,909,750 | 10/1959 | Pitzer | 338/176 |
| 3,392,360 | 7/1968 | Guggenheim et al. | 338/176 |

*Primary Examiner*—C. L. Albritton

*Attorney, Agent, or Firm*—Armstrong, Nikaido, Marmelstein & Kubovcik

[57] ABSTRACT

A slide-type potentiometer for speed control of electric motors under control of a foot-pedal actuator mechanism comprising an actuating rod reciprocatably movable in the longitudinal directions thereof, a spring member for urging the actuating rod in one of the longitudinal directions, a contact supporting member having an electrical contact secured thereto and mounted on the actuating rod so as to be movable in the longitudinal directions along with the actuating rod, a resistor element positioned such that the electrical contact member is slidably moved on the resistor element upon movement of the actuating rod, and a housing for enclosing the contact supporting member and the resistor element, the housing has a through-hole through which one end portion of the actuating rod extends outwardly.

3 Claims, 10 Drawing Figures

SLIDE-TYPE POTENTIOMETER

BACKGROUND OF THE INVENTION

1. Field of the Invention

The present invention relates to a potentiometer and more particularly to a slide-type potentiometer, such as a carbon composition and a wire wound potentiometer of slide-type, including a vertically movable actuating rod, which is used for controlling the rotational speed of an electric motor with the actuating rod interlocked to a foot-pedal actuator mechanism. In the slide-type potentiometer, a sliding contact is slideably disposed to be electrically in contact with a resistor element such as a carbon composition and a wire wound resistor element and mechanically coupled with the actuating rod so that the resistance of the potentiometer may be varied by moving the actuating rod with a foot pedal vertically.

2. Description of the Prior Art

In hithereto known slide-type potentiometers for controlling the rotational speed of the electric motors, the foot-pedal actuator mechanism interlocked to those potentiometers requires a relatively large number of parts and thus its construction is relatively complicated, and therefore when such hitherto known slide-type potentiometers are used, the foot-pedal actuator mechanism becomes relatively high in cost since it requires considerably time in the assembling process, and besides since the slide-type potentiometers have the opened portions and apertures, those are very susceptible to deposition of dust and foreign particles which give rise to failure.

SUMMARY OF THE INVENTION

It is an object of the present invention to provide a slide-type potentiometer which obviates the above-described disadvantages of the hitherto known slide-type potentiometer.

It is another object of the present invention to provide a slide-type potentiometer which allows a foot-pedal actuator mechanism to be implemented in a relatively small size with a simplified structure.

It is still another object of the present invention to provide a slide-type potentiometer of an enclosed structure which is not susceptible to failure and thus may enjoy a long service life.

In view of the above and other objects which will become more apparent as description proceeds, there is provided according to a general aspect of the invention a slide-type potentiometer which comprises an actuating rod member reciprocatably movable in the longitudinal directions thereof, a spring member for urging the actuating rod in one of the longitudinal directions, a contact supporting member having an electrical contact member secured thereto and mounted on the actuating rod member so as to be movable in the longitudinal directions along with the actuating rod member, a resistor element positioned such that the electrical contact member is slideably moved on the resistor element upon movement of the actuating rod member, and a housing member for enclosing the contact supporting member and the resistor element, the housing member having a throughhole for extending therethrough one end portion of the actuating rod member outwardly.

DESCRIPTION OF THE PREFERRED EMBODIMENTS

Figure 1A:
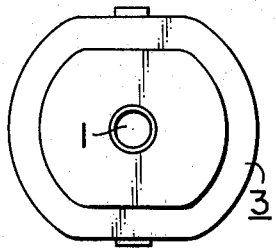
FIGS. 1A and 1B are a top plan view and an elevational sectional view, respectively, showing a housing of the slide-type potentiometer according to an embodiment of the invention.
Figure 1B:
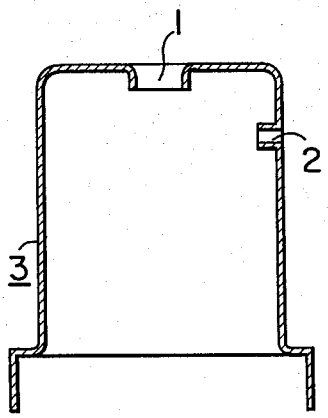

Now, the invention will be described in detail in conjunction with the exemplary embodiment shown in the drawings. FIG. 1A is a top plan view of a housing of the slide-type potentiometer according to an embodiment of the invention, and FIG. 1B is an elevational sectional view of the same. As can be seen from these figures, the housing 3 of the slide-type potentiometer may be made of a zinc-plated sheet iron or the like in the form of a hollow cylindrical configuration having an open bottom. An opening 1 is formed in the top wall of the housing, while another opening 2 is formed in a side wall. Each of these openings 1 and 2 may be preferably implemented in form of a sleeve projecting interiorly of the housing.

Figure 2A:
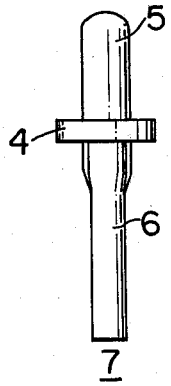
FIGS. 2A and 2B are a side elevational view and a bottom plan view, respectively, showing an actuating rod of the slide-type potentiometer according to the invention.
Figure 2B:
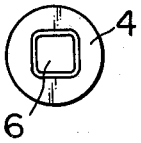

Referring to FIGS. 2A and 2B which show an actuating rod 7 of the slide-type potentiometer in a side elevational view and a bottom plan view, respectively, the actuating rod 7 is made of an electrically insulating material such as phenolic resin or the like and is provided with a collar 4 at a position slightly above the longitudinal center thereof. The upper portion 5 of the actuating rod 7 extending upwardly from the collar 4 as viewed in FIG. 2A is of a cylindrical configuration and has an appropriate length. On the other hand, the lower portion 5 of the actuating rod 7 extending downwardly from the collar 4 and having a reduced size as compared with the upper cylindrical portion 4 is implemented in a form of a quadrangular column having a substantially rectangular or square cross-section.

Figure 3:
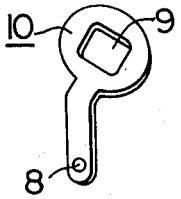
FIG. 3 is a perspective view of a contact supporting member constituting a part of the slide-type potentiometer according to the invention.

Referring to FIG. 3, an electrical contact mounting member 10 of an electrically conducting material is provided which has a disc-like fitting portion formed with a substantially square aperture 9 through which the quadrangular column portion 6 of the actuating rod 7 may extend. A depending leg 8 bent in L-like configuration is formed integrally with the disc-like fitting portion and has a lower free end portion at which an opening 8 is formed for fixedly mounting an electrical contact.

Figure 4A:
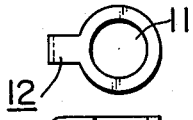
FIGS. 4A and 4B are a top plan view and a side view of a guide plate constituting a part of the slide-type potentiometer according to the invention.
Figure 4B:
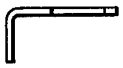

FIGS. 4A and 4B show a top plan view and a side view of a guide plate 12 of the slide-type potentiometer respectively. As can be seen from these figures, the guide plate 12 made of an electrically conductive material comprises a disc having a substantially circular aperture 11 through which the quadrangular column portion 6 can extend and a depending leg bent in L-like form.

Figure 5A:
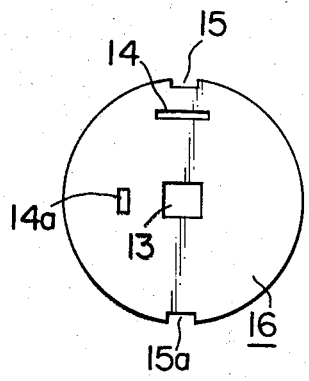
FIGS. 5A and 5B are a top plan view and a sectional view, respectively, showing a spacer member employed in the slide-type potentiometer according to the invention.
Figure 5B:
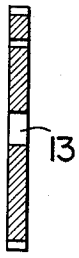

Further, the slide-type potentiometer comprises a disc-like spacer member 16 made of an electrically insulating material such as phenolic resin or the like, as is shown in a top plan view and a side view of FIGS. 5A and 5B, respectively. The disc-like spacer member 16 has a substantially square through-hole 13 formed at a center portion thereof and a slot 14*a* formed in line with the through-hole 13 as viewed in the vertical direction in FIG. 5A. A pair of notches 15 and 15*a* are formed in a peripheral edge of the disc-like spacer in diametrical opposition to each other and in line with the aperture 13 and the slot 14. Further, a slit 14*a* is formed in lateral juxtaposition with the square hole 13 and adapted to receive therein the bent leg of the guide plate 12.

Figure 6:
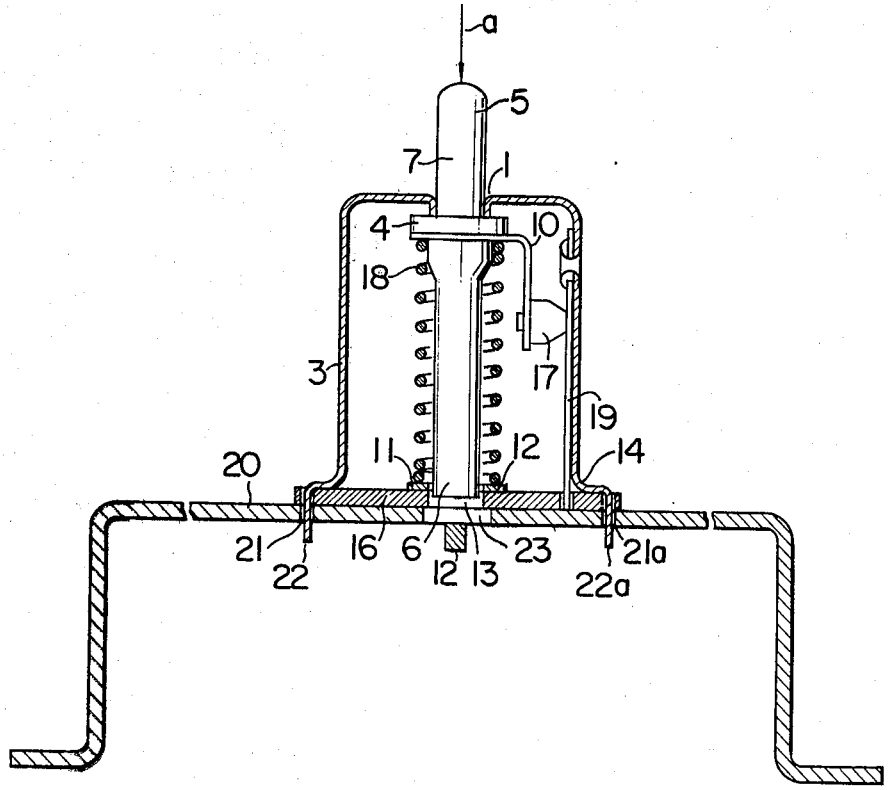
FIG. 6 is a vertical sectional view showing the slide-type potentiometer according to an embodiment of the invention in the assembled state.

Referring to FIG. 6, for assembling the slide-type potentiometer with the components described above, the upper cylindrical portion 5 of the actuating rod 7 is inserted through the sleeve 1 formed in the top wall of the housing 3 from the interior thereof. Subsequently, the electrical contact mounting member 10 having an electrical contact 17 secured thereto is mounted on the actuating rod 7 immediately below the collar 4 by inserting the quadrangular column portion 6 through the square opening 9 and then a return coil spring 18 of an electrically conductive material is mounted around the lower quadrangular column portion 6. Thereafter, the disc-like spacer member 16 is mounted on the quadrangular column portion 6 of the actuating rod 7 by inserting it through the center hole 13 formed in the spacer 16, while the guide plate 12 (FIG. 4) is interposed between the coil spring 18 and the spacer member 16. The elongated slot 14 formed in the spacer member 16 is adapted to receive fixedly therein an end portion of a resistor element 19 such as a carbon composition and a wire wound resistor element. On the other hand, the slit 14*a* is adapted to receive the depending leg of the guide plate 12 which leg serves as a terminal member. Reference numeral 20 denotes a base plate having a printed conductor circuit thereon in which slots 21 and 21*a* are formed to receive corresponding tongues 22 and 22*a* formed in the lower edge of the housing 3. By bending or twisting the tongues 22 and 22*a*, the housing 3 is secured to the base plate 20. It is preferred to secure more rigidly the housing 3 to the base plate 20 by soldering. An aperture 23 is formed in the base plate 20 to allow the quadrangular column portion 6 of the actuating rod 7 to freely extend therethrough. It should be appreciated that the tongues 22 and 22*a* are received in the notches 15 and 15*a*, respectively, thereby to prevent rotational tendency of the spacer member 16 and that they serve as the electrical terminal members.

In operation of the slide-type potentiometer of the construction described above, upon application of a pressing force onto the upper cylindrical portion 5 of the actuating rod 7 in the direction indicated by an arrow a, the electrical contact member 17 is caused to be slidably moved on the resistor element 19 thereby to vary correspondingly the resistance value between the contact member 17 and the one end portion of the resistor element 19 inserted through the slot 14 of the guide plate 16 and electrically connected to the printed conductor circuit on the base plate 20. When the pressing force is removed, the actuating rod 7 together with the contact member 17 is returned to the original state under the influence of the spiral return spring 18. In this manner, the resistance value of the slide-type potentiometer can be varied merely by moving the actuating rod 7 in the vertical direction as viewed in FIG. 6 thereby to slidably move the contact member 17 relative to the resistor element 19.

As will be appreciated from the foregoing description, the slide-type potentiometer according to the invention can be assembled in a much more easily facilitated manner and is suited for fabrication on a mass-production base. Further, the much simplified structure of the foot-pedal actuator mechanism using the slide-type potentiometer according to the invention will contribute to a great reduction in manufacturing costs. Besides, because of the closed structure of the slide-type potentiometer, deposition of dust or foreign materials on the surface of the resistor element can be positively prevented, whereby a long use life of the slide-type potentiometer can be assured in addition to its smooth operation with being scarcely susceptible to any failure.

We claim:

1. A slide-type potentiometer comprising:

(a) an actuating rod member movable reciprocatably in the longitudinal directions thereof, (b) a spring member for urging said actuating rod member in one of said longitudinal directions, (c) an electrical contact supporting member mounted on said actuating rod member so as to be movable in said longitudinal directions along with said actuating rod member, said contact supporting member having an electrical contact member secured thereto at one end thereof, (d) a resistor element positioned such that said electrical contact member is slidably moved on said resistor element upon movement of said actuating rod member, (e) a housing member for enclosing said contact supporting member and said resistor member, said housing member having a through-hole through which one end portion of said actuating rod member extends outwardly and at least two first terminal members projecting from the bottom thereof and electrically connected to said resistor element, and (f) a guide member for said spring member, wherein said guide member has a second terminal member projecting beyond the bottom of said housing member and electrically connected to said electrical contact member by way of said spring member and said contact supporting member.

2. A slide-type potentiometer as set forth in claim 1, wherein said first terminal members are formed integrally with said housing member, while said second terminal member is formed integrally with said guide member.

3. A slide-type potentiometer as set forth in claim 2, wherein said first terminal members additionally serve as means for securely mounting said housing on a base plate.

* * * * *